United States Patent [19]

Bianchini et al.

[11] Patent Number: 4,852,275

[45] **Date of Patent: * Aug. 1, 1989**

[54] SHOE HAVING A RIGID BACK PART

[75] Inventors: William L. Bianchini, Elmwood; Gary P. Duclos, Newburyport, both of Mass.

[73] Assignee: Highland Import Corporation, Marlboro, Mass.

[ * ] Notice: The portion of the term of this patent subsequent to Nov. 10, 2004 has been disclaimed.

[21] Appl. No.: 118,842

[22] Filed: Nov. 9, 1987

Related U.S. Application Data

[63] Continuation-in-part of Ser. No. 911,370, Sep. 25, 1986, Pat. No. 4,704,808.

[51] Int. Cl.[4] ..... A43B 1/10; A43B 3/14; A43B 9/00; A43B 23/08

[52] U.S. Cl. ..... 36/102; 36/11; 36/12; 36/17 R; 36/22 R; 36/68; 12/142 MC

[58] Field of Search ..... 36/102, 68, 69, 43, 36/44, 76 C, 12, 14, 11, 22 R, 17 R, 114; 12/142 MC

[56] References Cited

U.S. PATENT DOCUMENTS

| | | | |
|---|---|---|---|
| 1,602,557 | 10/1926 | Stiel | 36/68 X |
| 2,200,665 | 5/1940 | Ruszczyk . | |
| 2,211,509 | 8/1940 | Lumbard . | |
| 2,232,767 | 2/1941 | Brophy . | |
| 2,420,466 | 5/1947 | Cordeau | 12/142 MC |
| 2,656,620 | 10/1953 | Taylor | 36/17 R |
| 2,822,557 | 2/1958 | Stritter . | |
| 2,866,211 | 12/1958 | Herlihy | 12/142 MC |
| 2,994,136 | 8/1961 | Reinhart et al. . | |
| 3,170,253 | 2/1965 | Johnson | 36/22 R |
| 3,785,915 | 1/1974 | Closson, Jr. . | |
| 4,224,747 | 9/1980 | Winfield | 36/11 |
| 4,231,169 | 11/1980 | Toyama et al. . | |
| 4,322,895 | 4/1982 | Hockerson . | |
| 4,501,076 | 2/1985 | Dodds | 36/11 |
| 4,551,929 | 11/1985 | Paris | 36/11 |
| 4,625,435 | 12/1986 | Ueda . | |
| 4,704,808 | 11/1987 | Bianchini et al. | 36/102 |

FOREIGN PATENT DOCUMENTS

| | | | |
|---|---|---|---|
| 446658 | 3/1949 | Italy | 36/11 |
| 323890 | 1/1985 | Italy . | |
| 272234 | 5/1951 | Switzerland . | |
| 318360 | 9/1929 | United Kingdom | 36/68 |
| 2114869 | 9/1983 | United Kingdom | 36/114 |

*Primary Examiner*—James Kee Chi

*Attorney, Agent, or Firm*—Saidman, Sterne, Kessler & Goldstein

[57] ABSTRACT

A shoe having a uniquely shaped platform along the rear peripheral edge of the insole, which is constructed of a rigid backpart material. By combining it with a construction of a specially molded outflange counter and using a sturdy stitched lasting construction fastening securely the outward flange of the counter with the specially lasted molded leather upper together with the outward extension of the specially shaped insole platform, a stable support system is formed to control the lateral and longitudinal orientation of the foot when walking. The forepart of the shoe may be of moccasin. Strobel modified welt-type or other construction which provides varying degrees of flexbility.

25 Claims, 12 Drawing Sheets

SHOE HAVING A RIGID BACK PART

INTRODUCTION

This application is a continuation-in-part of our copending application Ser. No. 911,370 filed Sept. 25, 1986, entitled Shoe Having Rigid Back Part and Flexible Forepart, now U.S. Pat. No. 4,704,808 dated Nov. 10, 1987.

This invention relates to a new and improved suitable for walking or other active use and which in most embodiments is relatively lightweight.

Conventionally made lightweight shoes that may be used for walking or other similar activity frequently have relatively soft soles and are cement lasted. The counters have inwardly turned lasting flanges and therefore offer little resistance to roll over particularly because of the soft soles with which they ar used.

Important objects of the present invention as well as of the invention disclosed in application Ser. No. 911,370, supra, are to provide a lightweight walking shoe with a soft outsole but which provides very substantial lateral stability to the foot; to provide a walking shoe which has great resistance to roll over, particularly at the back part of the shoe; and to provide a walking shoe which has very substantial fore and aft flexibility while providing great lateral stability.

To accomplish these and other objects, all the shoes of both the present invention and that in U.S. Pat. No. 4,704,808, supra include an upper with a molded counter having an outwardly extending flange. The insole or other sole component to which the upper is attached is provided with a wide lasting margin at the back part to which the upper leather and the external counter flange is stitched.

The shoe of the prior application also includes an insole having a flexible forepart and stiff back part. The forepart of the upper is cement lasted to the flexible forepart of the insole. The margin of the upper is wrapped about the edge of the counter flange and insole margin to its bottom surface. The outwardly flanged counter and stiff insole cooperate to produce a back part which has great stability so as to resist roll over at the heel and twisting of the foot. The wrapped construction of the upper about the edge of the insole is most attractive. The stiff and stable back part does not interfere with the flexing of the forepart of the sole so that the shoe is suitable for vigorous activity.

The shoes disclosed in the present application have forepart constructions which are different from the cement lasted forepart of the earlier application. In some of the embodiments, a moccasin forepart construction is employed; in another embodiment, a modified welt construction is used; and in other embodiments, a Strobel construction is used. All with the exception of the modified welt construction provide a relatively flexible forepart which in combination with the construction at the rear part provide a shoe suitable for vigorous activity. The embodiment with the modified welt construction may be particularly suitable for use as a work shoe.

These and other objects and features of the invention will be better understood and appreciated from the following detailed description read in connection with the accompanying drawings.

BRIEF FIGURE DESCRIPTION

DETAILED DESCRIPTION

Figure 1:
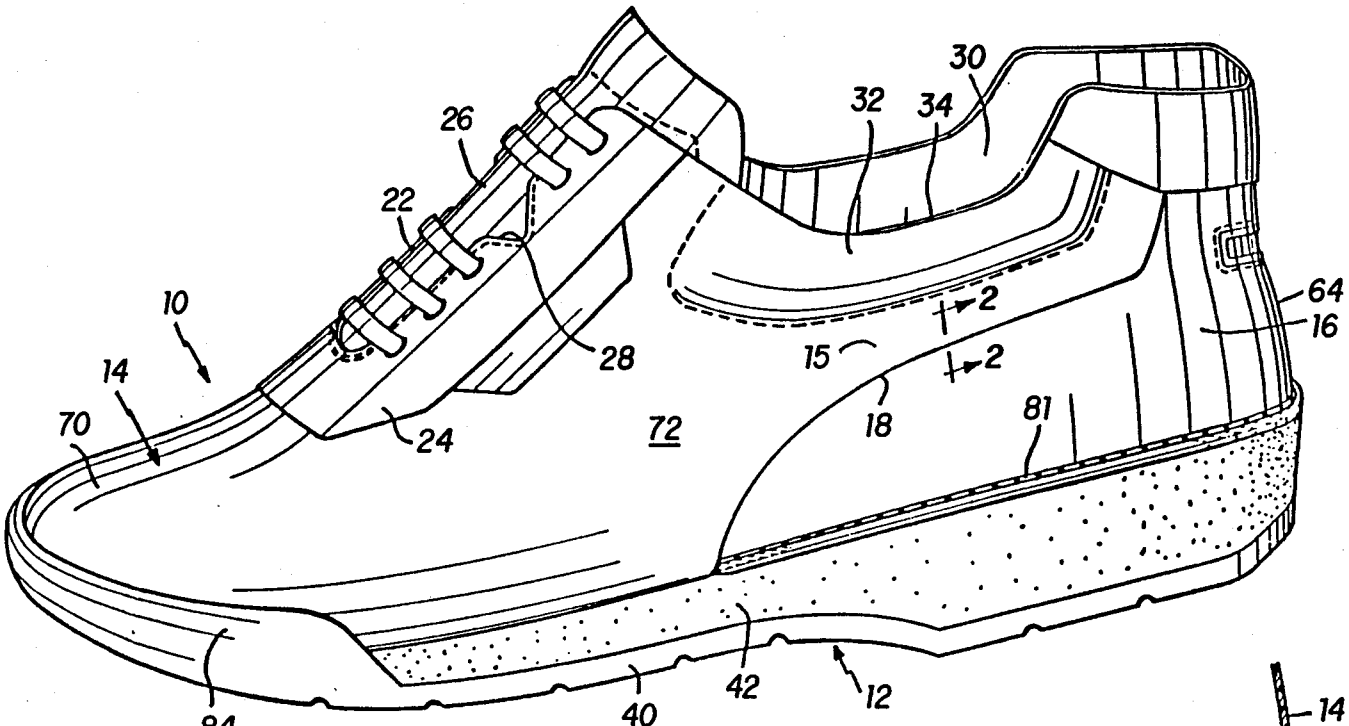
FIG. 1 is a perspective view of a walking shoe constructed in accordance with the invention disclosed in our earlier copending application Ser. No. 911,370.
Figure 2:
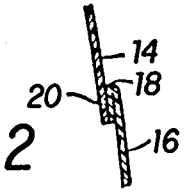
FIG. 2 is a fragmentary cross-sectional view thereof taken along section line 2—2 of FIG. 1.

The walking shoe shown in FIGS. 1–7 is described in our copending application Ser. No. 911,370 and includes an upper 10 and sole 12. The upper 10 has a vamp 14 and quarters 15 attached by a row of stitching 20 to the upper foxing 16 along the pattern line 18. The seam 20 is hidden by a fold along the intersecting edge of the foxing 16 as illustrated in FIG. 2. The vamp 14 of the upper is provided with a lace opening 22 finished by an eye stay 24 and tongue 26. For comfort and flexibility, a notch 28 is provided in the lace opening 22 on each side thereof between the bottom and top of the opening. A lining 30 is also stitched to the upper and extends about the inner surface of the vamp 14 and quarters 15. The lining may be pig skin, fabric or other similar material, or combinations thereof. A padded collar 32 is also provided about the upper edge 34 of the top of the upper to give increased comfort to the wearer.

Figure 3:
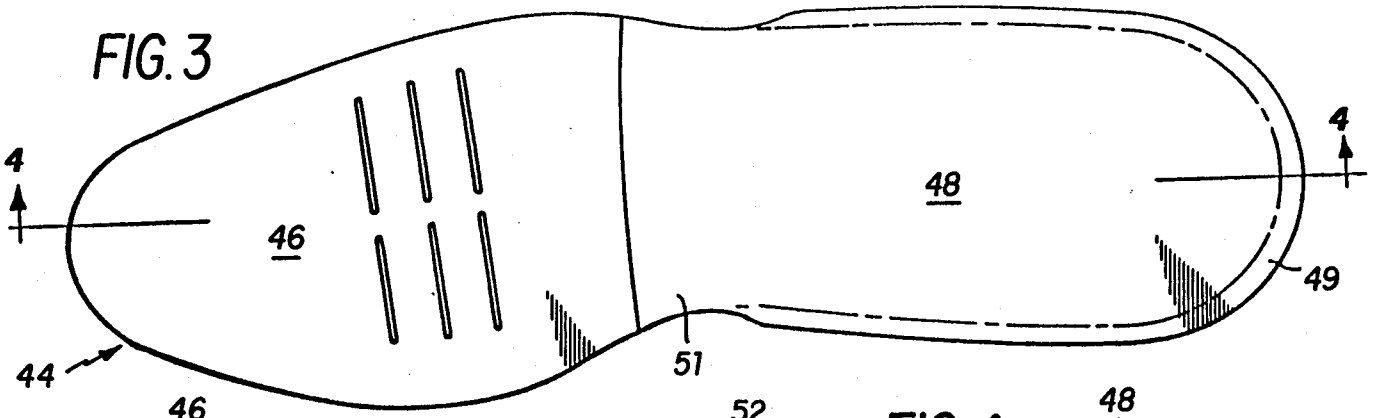
FIG. 3 is a bottom plan view of the insole of the shoe shown in FIG. 1.

The sole 12 includes an outsole 40, midsole 42 and insole 44. The insole is made of two pieces and combined as indicated in FIG. 3 just rearwardly of the ball of the foot. Insole 44 has a forepart 46 and a back part 48 whose adjacent edges are overlapped as shown in detail in FIG. 4. The overlapped adjacent edges 50 and 52 of the forepart and back part may be cemented together by any of the well-known cement products used in the shoe industry. The forepart 46 of insole 44, typically may be made of Texon No. 485, which is quite flexible so as to reduce the stiffness of the sole at the forepart of the shoe. The back part 48 of the insole may be made of Texon T-90 which is a relatively firm material so as to impart stability to the back part of the insole. The back part 48 of the insole 44 is shown to have a wide margin 49 that extends from the rear of the shank area 51 about the heel. The margin 49 cooperates with the outwardly extending flange of the counter, as described below. The Texon products identified are manufactured by United Shoe Machine Corp. Obviously, other comparable materials may be used.

Figure 5:
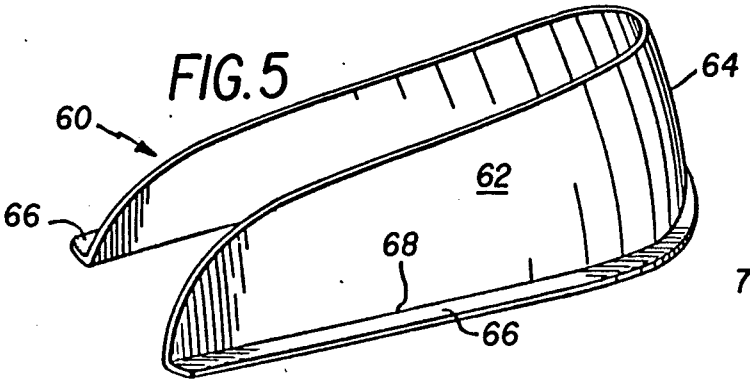
FIG. 5 is a perspective view of the molded counter which forms part of the shoe.

In FIG. 5, a molded counter 60 is shown that is incorporated into the upper of the shoe at the quarters 15 between the foxing 16 and the lining 30. The counter 60 is generally U-shaped when viewed from above and has a relatively stiff side wall 62 which extends about the heel portion of the upper and diminishes in height toward the forepart from the back stay 64 of the shoe. The counter has an outwardly extending flange 66 about its lower edge 68 that forms a lasting margin to assemble the shoe as is described in detail below. During the assembling of the upper 10, the counter is inserted between the foxing 16 and the lining 30. The flange 66 plays a major roll in imparting lateral stability to the shoe to reduce the danger of twisting the foot or ankle of the wearer.

Figure 6:
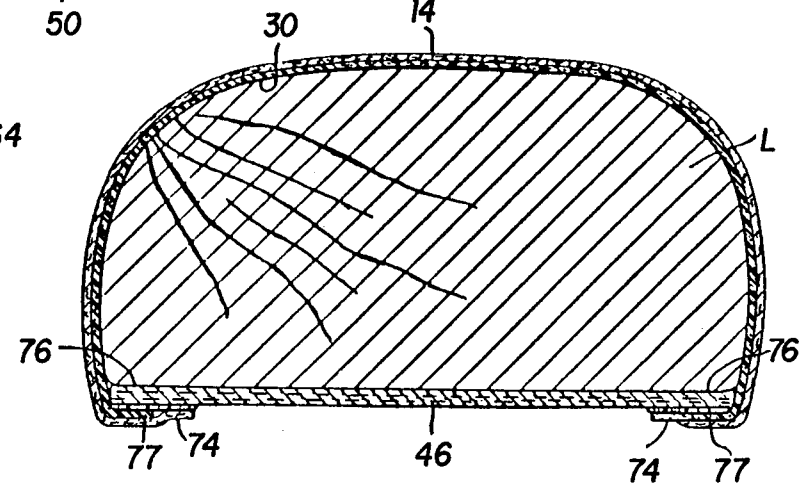
FIGS. 6 and 7 are vertical cross-sectional views of the shoe of FIG. 1, taken through the forepart and back part, respectively, and showing the partially assembled shoe on a last.
Figure 7:
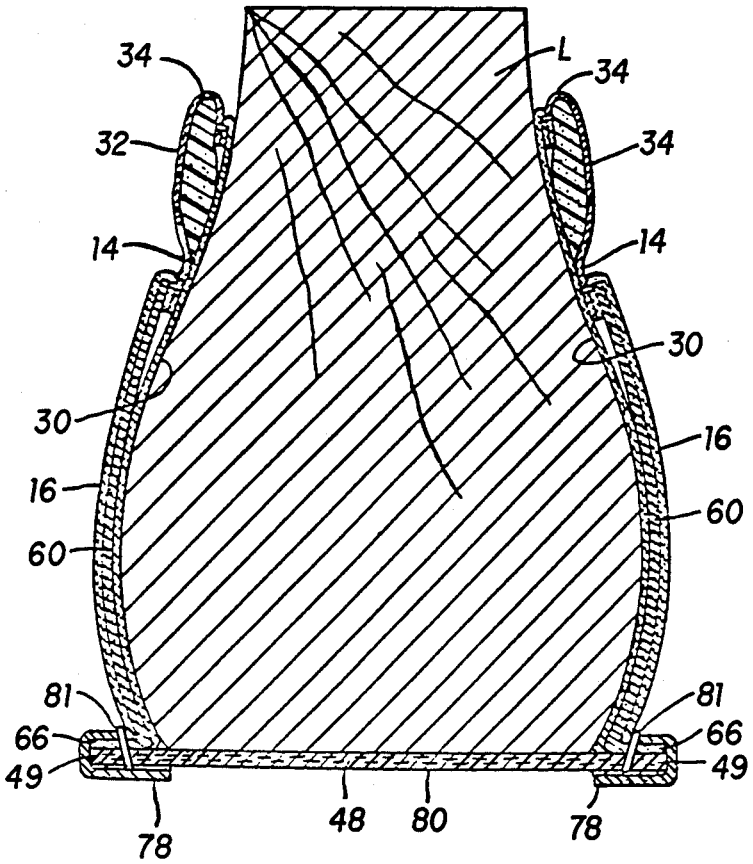

The one piece vamp 14 of the upper extends about the toe area 70 and the sides 72 and includes a lasting margin 74 immediately adjacent the feather edge sized to extend under the margin 76 of the forepart 46 of insole 44 as shown in FIG. 6. Similarly, the lining 30 has a lower margin 77 which may be wrapped under the insole margin 76. Foxing 16 is provided with a lasting margin 78 which extends over the flange 66 of the counter and is wrapped under the wide margin 49 of insole back part 48 as shown in FIG. 7.

As indicated above, the shoe construction of this embodiment is cement lasted at the forepart and stitched down at the rear part to achieve the several advantages stated. FIG. 6 shows the lasting margin 74 of the forepart of the upper wrapped under the margin 76 of the insole forepart 46 immediately adjacent the feather edge and cemented in place. FIG. 7 shows that the stiff flange 66 of molded counter 62 and the lower portion of the foxing 16 are turned outwardly from the feather edge over the wide margin 49 of the insole back part 48 and are stitched together by stitching 81, while the extreme edge 78 of the margin of the foxing 16 is wrapped under the margin 49 of the insole back part 48 and cemented down in place.

In the manufacture of the shoe, the upper consisting of the vamp 14, foxing 16, eye stay 24 and tongue 26 along with the lining 30 are assembled in the manner shown and described, and thereafter the counter 60 is inserted into the back part of the upper between the foxing 16 and lining 30. The back part of the upper is then molded and flanged out at the bottom to form the flange 66 in the counter and the outward flare in the foxing 16 by means of heat and pressure with the aid of male and female molds.

Figure 4:
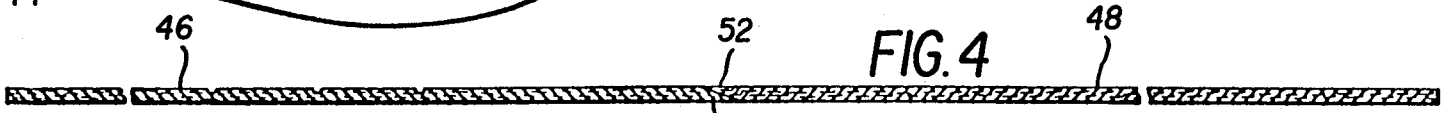
FIG. 4 is a fragmentary cross-sectional view of the insole taken on section line 4—4 of FIG. 3.

As a separate and independent process, the insole 44 is formed by cementing together the flexible forepart 46 and the firm back part 48 along their respective margins as shown in FIG. 4.

After the upper 10 and insole 44 are formed in the manner described, the insole 44 and upper 10 are precemented about their edges with a ribbon of cement approximately one-half inch wide.

The insole 44 is next tacked to the bottom of the last L with the cement ribbon on the face of the insole away from the last bottom. The forepart of the upper 10 is then cement lasted to the forepart 46 of the insole 44 by wrapping the margin 77 of lining 30 and the margin 74 of the vamp tightly over the bottom margin 76 of the insole as suggested in FIG. 6. The bond between the margins is very quickly formed by the cement ribbons applied to the margins before lasting Next, the lasting margin 78 of foxing 16 and its lining margin, if any, are machine lasted and cemented to the upper surface of the flange 66 of counter 60, and then the margin of the foxing and the flange 66 of the counter are stitched to the upper surface of the wide margin 49 of the back part 48 of insole 44 by stitching 81, as suggested in FIG. 7. The side lasting is completed by blending in the forepart cement lasting with the back part stitch lasting at the arch area. This later operation may best be accomplished by hand.

The outer edge of the foxing margin 78 at the rear part is next wrapped around the edge of margin 49 of back part 48 of insole 44 onto the bottom surface 80 and cemented down to form a clean folded edge. Finally, the shoe assembly is completed by roughing the bottom surface of the insole 44 and the margins of the upper on that surface, and cementing the midsole 42 and outsole 40 in place. The midsole 42 and outsole 40 may be made of any material that provides suitable cushioning and traction for the wearer and of course has proper wear characteristics. The outsole may include a toe cap 84 as suggested in FIG. 1, and the midsole may be wedge-shaped to provide the appropriate lift for the foot. A sock lining (not shown) is also included in the shoe, which covers the upper surface of the insole and may provide additional cushioning for the foot.

It will be appreciated that the shoe of FIGS. 1–7 is very comfortable and has great forepart flexibility in a fore and aft direction while providing very substantial side to side stability so as to prevent roll over and twisting. The stiff back part of the insole provides a firm platform for the counter, and the outwardly extending flange 66 of the counter increases the effective width of the shoe at the heel to further resist roll over as compared to conventionally cement lasted lightweight athletic shoes.

Figure 8:
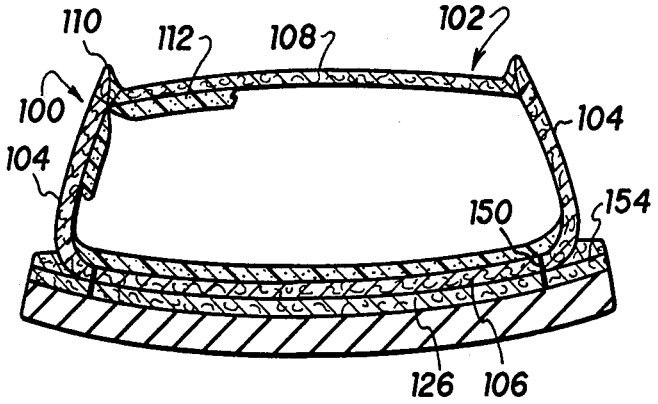
FIGS. 8 and 9 are vertical cross-sectional views taken through the forepart and rear part of a shoe constructed in accordance with one embodiment of this invention.
Figure 9:
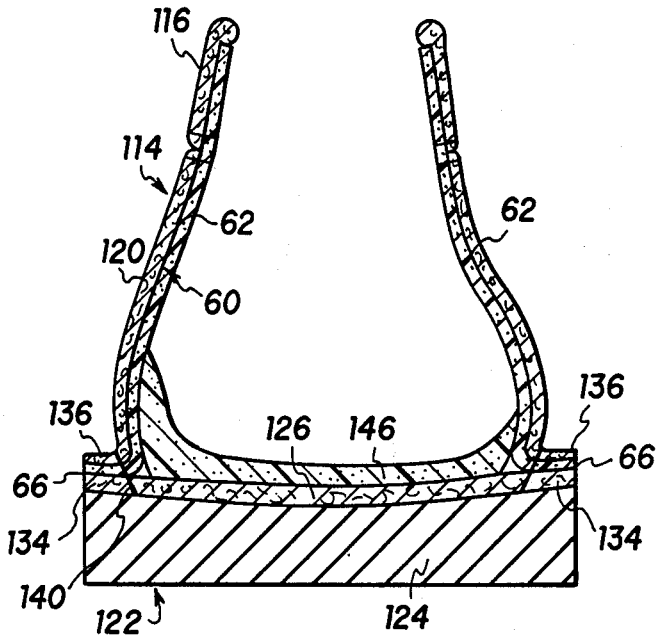
Figure 10:
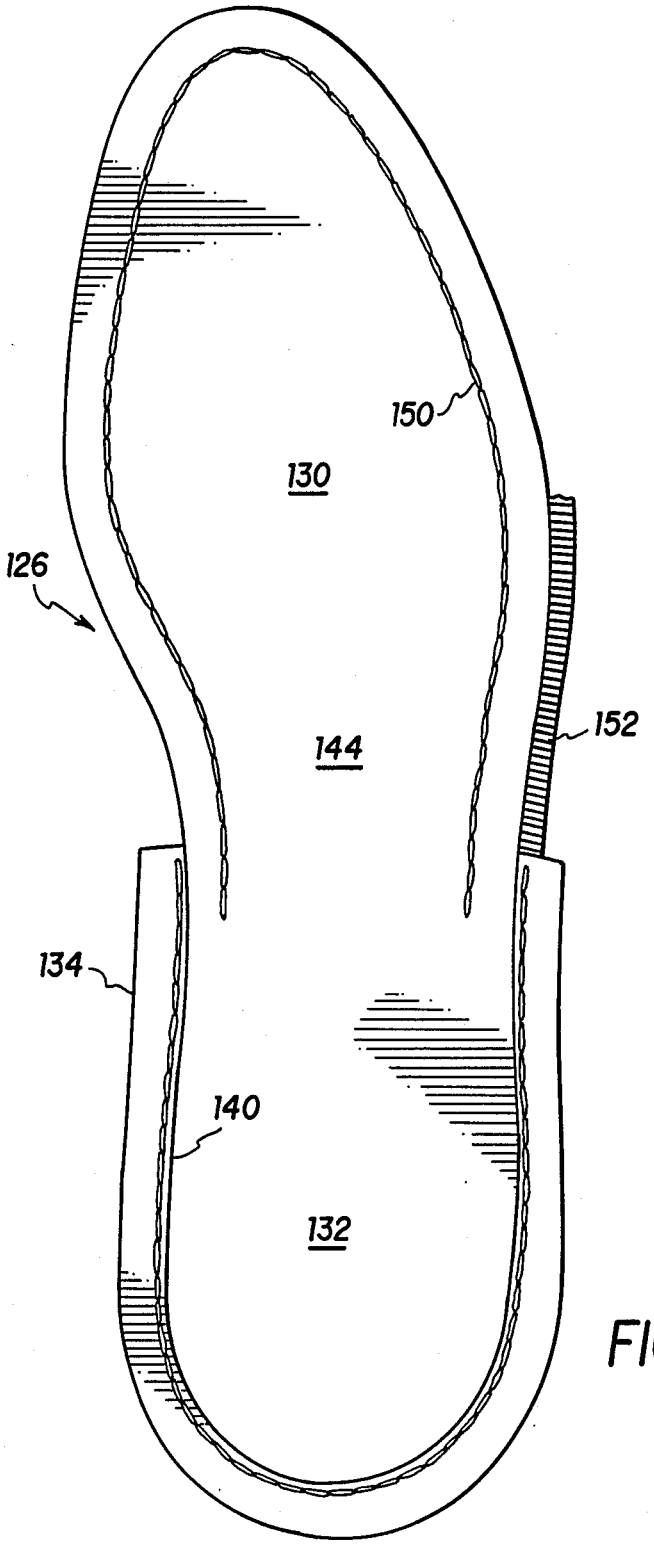
FIG. 10 is a plan view of the midsole of the shoe shown in FIGS. 8 and 9.

In FIGS. 8, 9 and 10, the present invention is shown embodied in a moccasin-type shoe construction. The upper 100 is shown in FIG. 8 to have a closed forepart 102 defined by the sides 104 and moccasin base 106. The top of the forepart is shown closed by a plug 108 stitched to the sides at 110. As FIG. 8 suggests at 112, the forepart may or may not be lined.

The rear part 114 of the upper shown in FIG. 9 is very similar to the rear part construction of FIG. 7. The rear part of the upper is shown in FIG. 9 to include a collar 116, and lining 118 and foxing 120 at the quarters. The rear part also includes the counter 60 of FIG. 5 having a relatively stiff side wall 62 and an outwardly extending flange 66.

The sole 122 to which the upper 100 is attached includes an outsole 124 and midsole 126. The midsole 126, one of the sole components, performs the same function and embodies many of the same features as the insole shown in FIGS. 3 and 4. The midsole 126 shown in FIG. 10 includes a forepart 130 and rear part 132 to which the forepart 102 and rear part 114 of the shoe upper are attached. Just as the insole of FIGS. 3 and 4, the midsole 126 includes a wide lasting margin 134 to which the external flange 66 of the counter and the lasting margin of the side quarters are attached.

Referring again to FIG. 9, it will be noted that the foxing 120 of the side quarters includes an outwardly extending lasting margin 136 which overlies the flange 66 of the counter, and the flange 66 and lasting margin 136 are stitched by means of Goodyear stitching 140 to the lasting margin 134 of midsole 126. Thus, the rear construction of the shoe of this embodiment provides the same lateral stability as provided in the shoe of FIGS. 1–7. The lower margin of the lining 118 at the rear part of the upper may or may not extend under the flange 66 between the margin 134 and the flange. The flange 66 and lasting margin 134 together extend to the shank area 144 of the midsole.

FIG. 9 also shows a heel cushion 146 for increased comfort cemented within the upper to the upper surface of the midsole 126.

The construction of the forepart of the shoe differs substantially from that shown in FIG. 6. In accordance with this embodiment, the closed forepart is secured to the sole structure 122 by Littleway stitching 150 joining the moccasin base 106 to the midsole 126. The extent of the Littleway stitching 150 is shown in FIG. 1 in the midsole 126

The forepart 130 of the midsole may or may not extend outwardly beyond the last bottom as suggested by the broken margin 152 in FIG. 10. If so extended, for decorative purposes a bonding welt 154 may be cemented to the upper surface of the margin 152 as shown in FIG. 8. The construction also may include a sock lining 156.

With the forepart construction shown in FIG. 8, substantially flexibility is imparted to the shoe at the forepart for increased wearer comfort while the back part of the shoe provides the laterally stability desired. This combination produces a shoe suitable for active wear. The moccasin forepart with Littleway stitching may provide greater flexibility at the forepart than the cement forepart lasting in the shoe of FIGS. 1–7.

Figure 11:
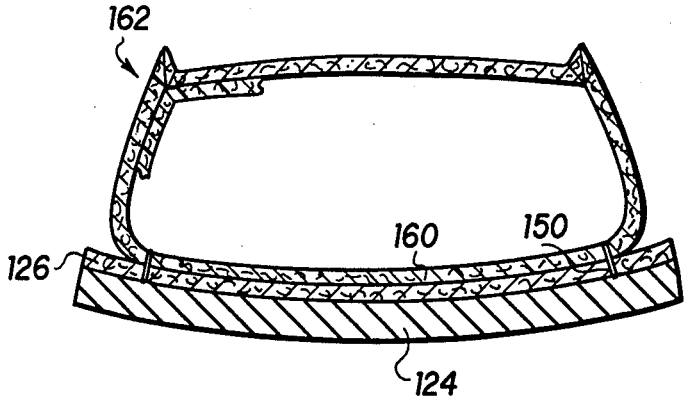
FIGS. 11 and 12 are vertical cross-sectional views of the forepart and rear part of another embodiment of shoe constructed in accordance with this invention.
Figure 12:
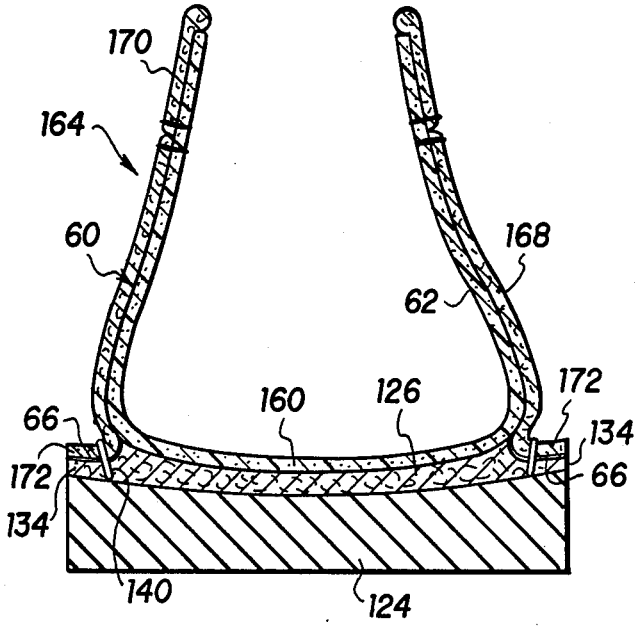

The embodiment of FIGS. 11 and 12 is very similar to the embodiment of FIGS. 8–10 but with some modifications. This embodiment employs so-called moccasin construction, both at the forepart and back part. That is, a moccasin base 160 closes the bottom of the forepart 162 and rear par 164 of the upper. The midsole 126 may be identical to that employed in the embodiment of FIGS. 8–10. Therefore, it is not separately illustrated. Similarly, the outsole 124 is the same as in the earlier embodiment.

With respect to the forepart 162 of the shoe, it will be noted in FIG. 11 that Littleway stitching 150 secures the moccasin base 160 of the upper to midsole 126, just as in the earlier embodiment.

Once again, the counter 60 of FIG. 5 is employed having a side wall 62 and flange 66. The counter 60 is sandwiched between the upper moccasin leather and foxing 168 which in turn is secured to a cuff 170. The foxing 168 includes a lasting margin 172 that overlies the flange 66 when the shoe is assembled. Goodyear stitching 140 joins the lasting margin 172 of the foxing and the flange 66 of the counter to the margin 134 of the midsole. In FIG. 12, midsole 126 is shown to be provided with an anatomic shape for increased wearer comfort. That configuration eliminates the need for a heel cushion insert.

This embodiment as the other embodiments provides a shoe having a back part with great lateral stability by virtue of the stiff-molded counter with its out turned flange in combination with the wide margin at the rear part of the sole component to which the flange and upper leather are stitched. The forepart of the shoe has substantial fore and aft flexibility as the sole and upper are attached together at the forepart by the Littleway stitching 150.

Figure 13:
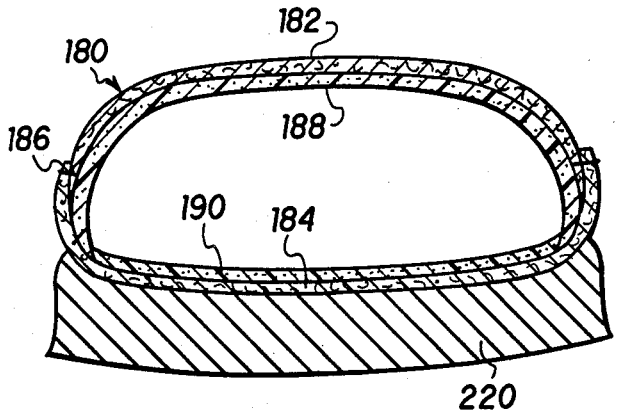
FIGS. 13 and 14 are vertical cross-sectional views of the forepart and rear part of still another embodiment of shoe constructed in accordance with this invention.
Figure 14:
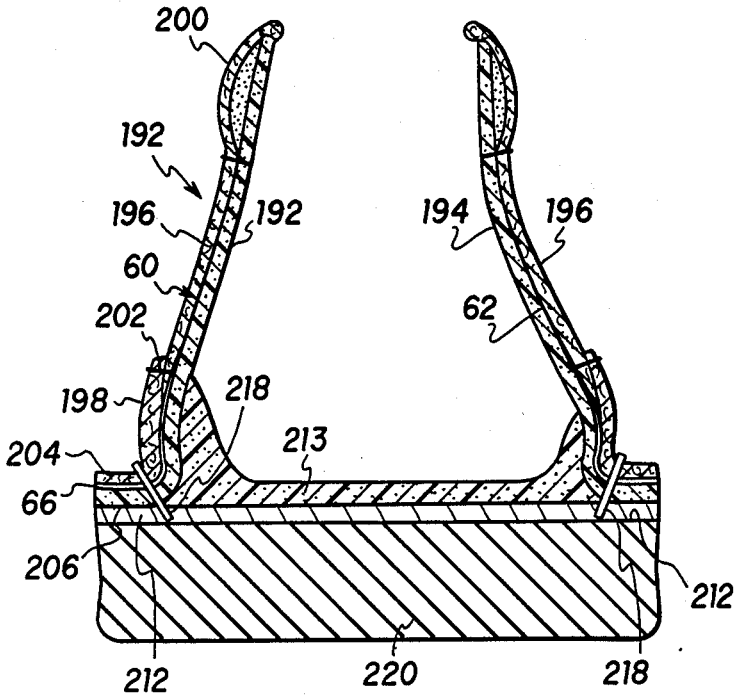
Figure 15:
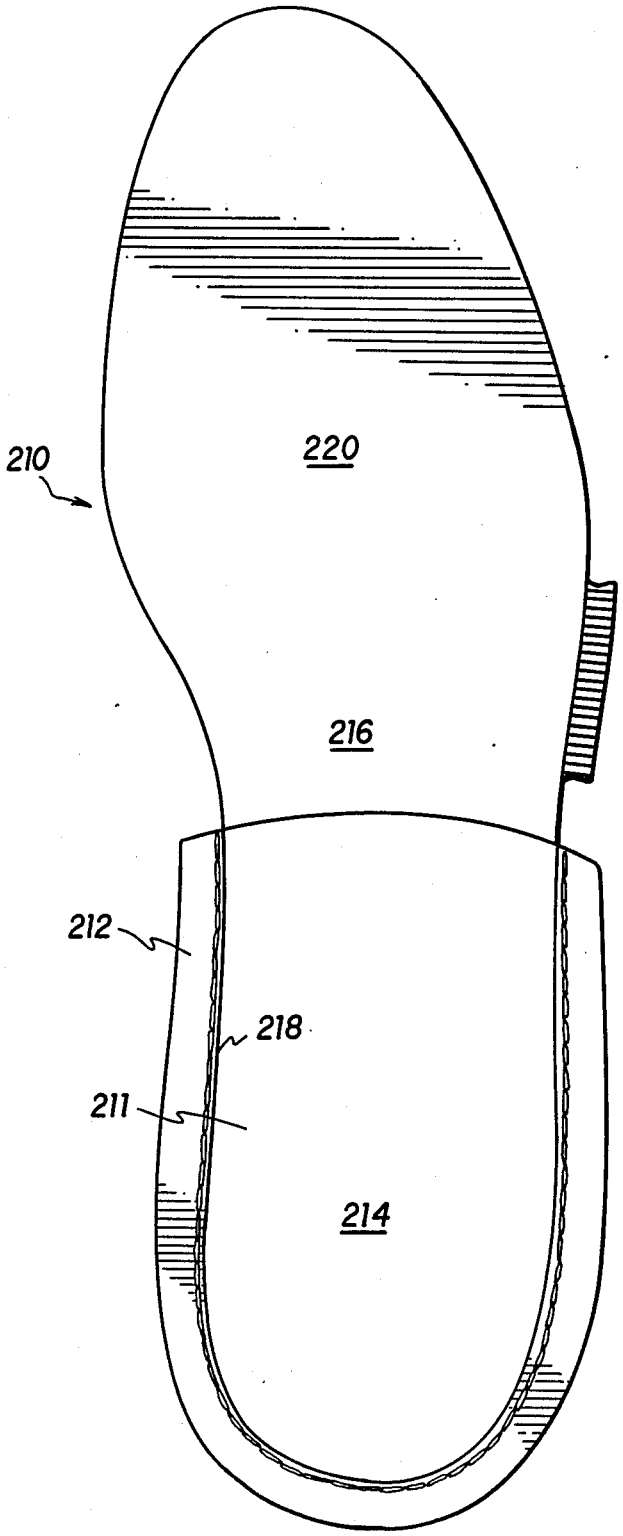
FIG. 15 is a plan view of the sole component of the shoe shown in FIGS. 13 and 14 the sole component being the midsole at the rear part and the outsole at the forepart of the shoe.

The embodiment of FIGS. 13–15, as do all of the embodiments of this invention, employs the stiff-molded counter 60 at the rear part. It is also of moccasin construction but it varies somewhat from the others. Referring particularly to FIG. 13, it will be noted that the forepart 180 has a hand sewn moccasin upper 182 closed by a moccasin base 184 secured to the moccasin upper with mudguard stitching 186. The upper surface of the forepart 180 is provided with a lining 188, while the base is covered by a sock lining 190.

The rear part 192 of the upper includes a lining 194 upper leather 196, mudguard 198 and the counter 60 FIG. 14 also shows the rear part 192 to be provided with a padded cuff 200.

In this embodiment, the counter 60 is enclosed between the lining 194 on the inside and the combination upper leather and mudguard 196, 198 on the outside. Mudguard 198 is shown stitched to the lower margin of the upper leather 196 by moccasin stitching 202. The lower portion of the mudguard 198 is provided with an outwardly turned margin 204 that overlies the flange 66 of the counter 60, while the lower portion of the lining 194 is provided with a margin 206 that underlies the flange 66.

The sole component 210 of this embodiment has a midsole 211 at its rear part 214 with a wide margin 212 that extends about the periphery forwardly to the shank area 216. The margin 204 of the mudguard 198, flange 66 of the counter 60 and margin 206 of the lining 194 are secured by Goodyear stitching 218 to the margin 212 of the sole component 210 as shown in FIGS. 14 and 15. An outsole 220 is shown secured to the lower surface of the midsole, and a contoured footbed 213 is inserted at the heel area.

In FIG. 13, the midsole 211 is shown not to extend to the forepart but terminates at the shank area 216 (see also FIG. 15), and the outsole 220 extends under the forepart of the upper. The moccasin base 184 is cemented directly to the upper surface of the outsole 220.

As in the other embodiments, the construction shown provides great lateral stability at the rear portion of the shoe by virtue of the configuration of the counter and the sole component to which it is attached, while the forepart of the shoe is very flexible. In this embodiment as in the other embodiments, the forepart of the upper is turned inwardly under the last when the shoe is made as opposed to the rear part where the lining and mudguard along with the flange of the counter are turned outwardly at the feather edge to increase the platform size and provide the stability desired.

Figure 16:
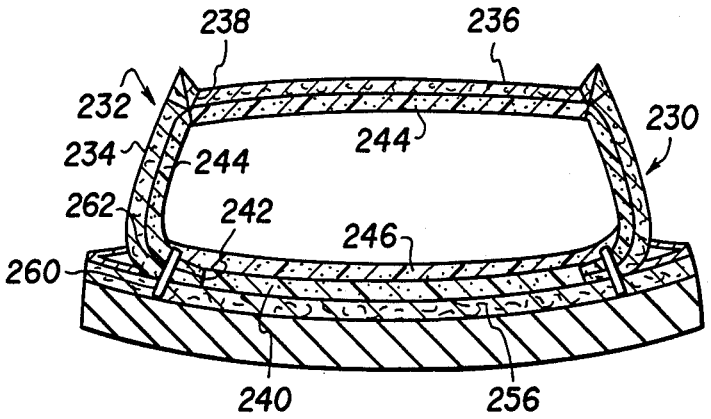
FIGS. 16 and 17 are vertical cross-sectional views through the forepart and rear part of yet another embodiment of this invention.
Figure 17:
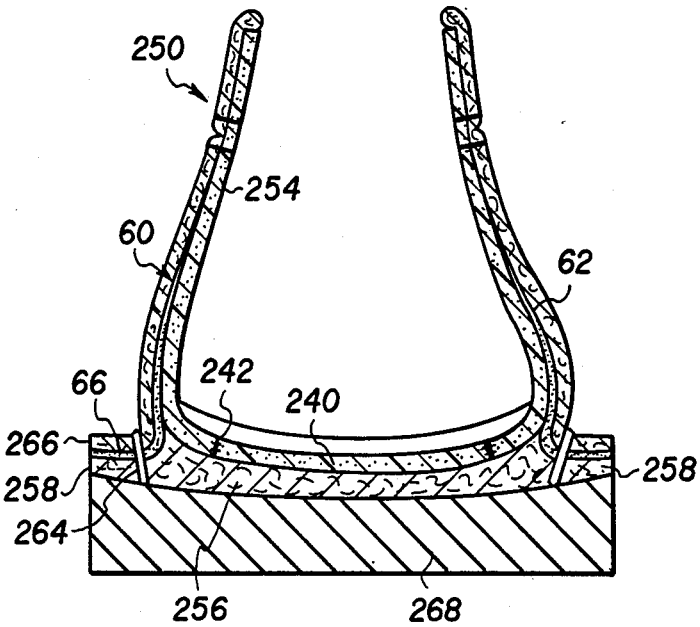
Figure 18:
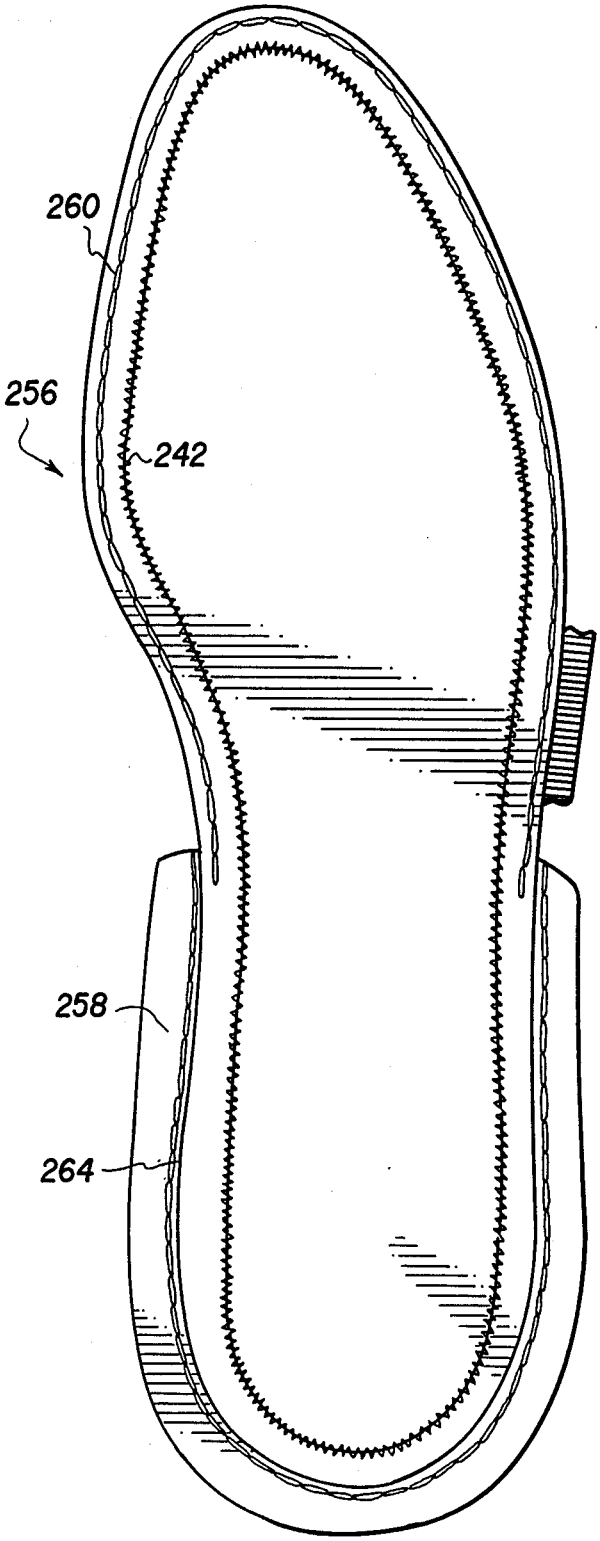
FIG. 18 is a plan view of the sole component of the shoe shown in FIGS. 16 and 17 and suggesting the location in plan of the Strobel stitching in the upper.

The embodiment shown in FIGS. 16–18 is yet another modification or variation of a moccasin-type construction This embodiment is less expensive to manufacture than the others. In FIG. 16, the forepart 232 of the moccasin upper 230 is shown made up of a vamp 234, plug 236 stitched to the vamp as suggested at 238 and a moccasin base or insole 240 connected to the inner margin of the vamp by Strobel stitching 242. In this embodiment, a lining 244 under the plug and on the inside of the vamp is provided at 244, and a sock lining is suggested at 246.

The rear part 250 of the upper shown in FIG. 17 includes the counter 60 of FIG. 5 having a side wall 62 and peripheral, outwardly extending stiff flange 66 disposed between the foxing 252 of the upper and the lining 254. The lower margin of the lining 254 is connected by Strobel stitching 242 to the moccasin base or insole 240 as a continuation of the stitching and moccasin base shown in FIG. 16 illustrating the forepart of the shoe.

The upper is assembled on the sole component or midsole 256 having a wide margin 258 at the rear portion as in the other embodiments of this invention. The Strobel stitching 242 is shown in FIG. 18, although the Strobel stitching does not connect the upper to the midsole Littleway stitching 260, suggested in FIG. 18 and shown in FIG. 16 passes through the lining 244 and lower margin 262 of the vamp and through the sole component or midsole 256 to secure the forepart of the upper to the sole structure. The rear part 250 of the upper is secured to the sole component or midsole 256 by the Goodyear stitching 264 which passes through the margin 266 of the foxing 252, the flange 66 of counter 60 and the margin 258 of the sole component. This arrangement is clearly illustrated in FIGS. 17 and 18. The sole structure is completed by the outsole 268 cemented to the bottom surface of the midsole 256. In this embodiment as in the embodiment of FIGS. 13–15, the rear part of the midsole is contoured to provide an anatomical platform. If desired, a bonded welt may be cemented to the margin of the midsole. The midsole and outsole may optionally be enlarged as suggested at 265 to increase forepart stability.

It will be appreciated that this embodiment as the previously described embodiments has a very flexible forepart, and great lateral stability at the rear part is provided by virtue of the configuration of the rear part of the upper including the counter, and the sole component with which it cooperates.

Figure 19:
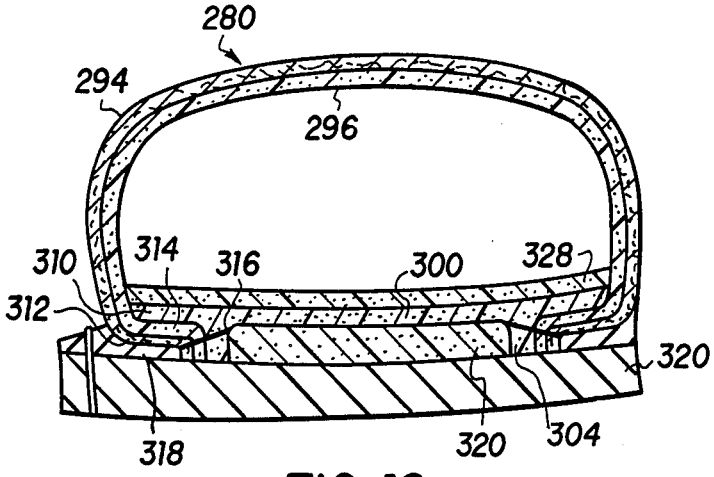
FIGS. 19 and 20 are vertical cross-sectional views through the forepart and rear part of another embodiment of this invention including a modified welt construction.
Figure 20:
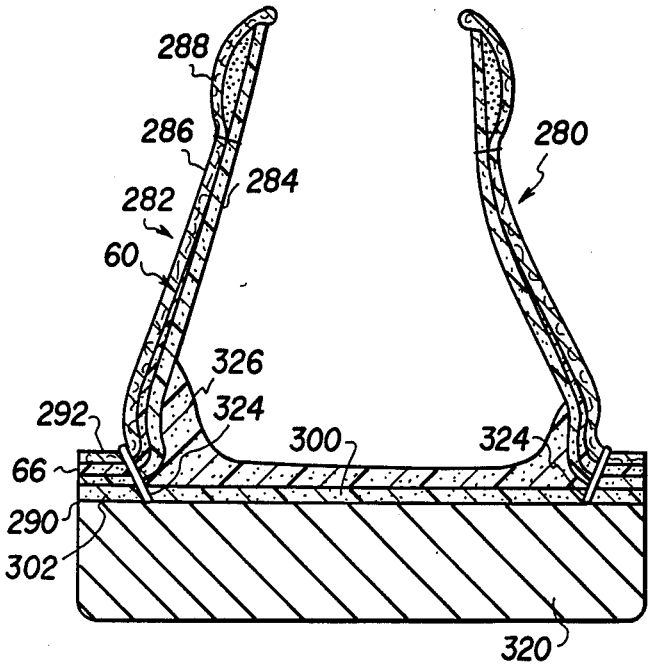
Figure 21:
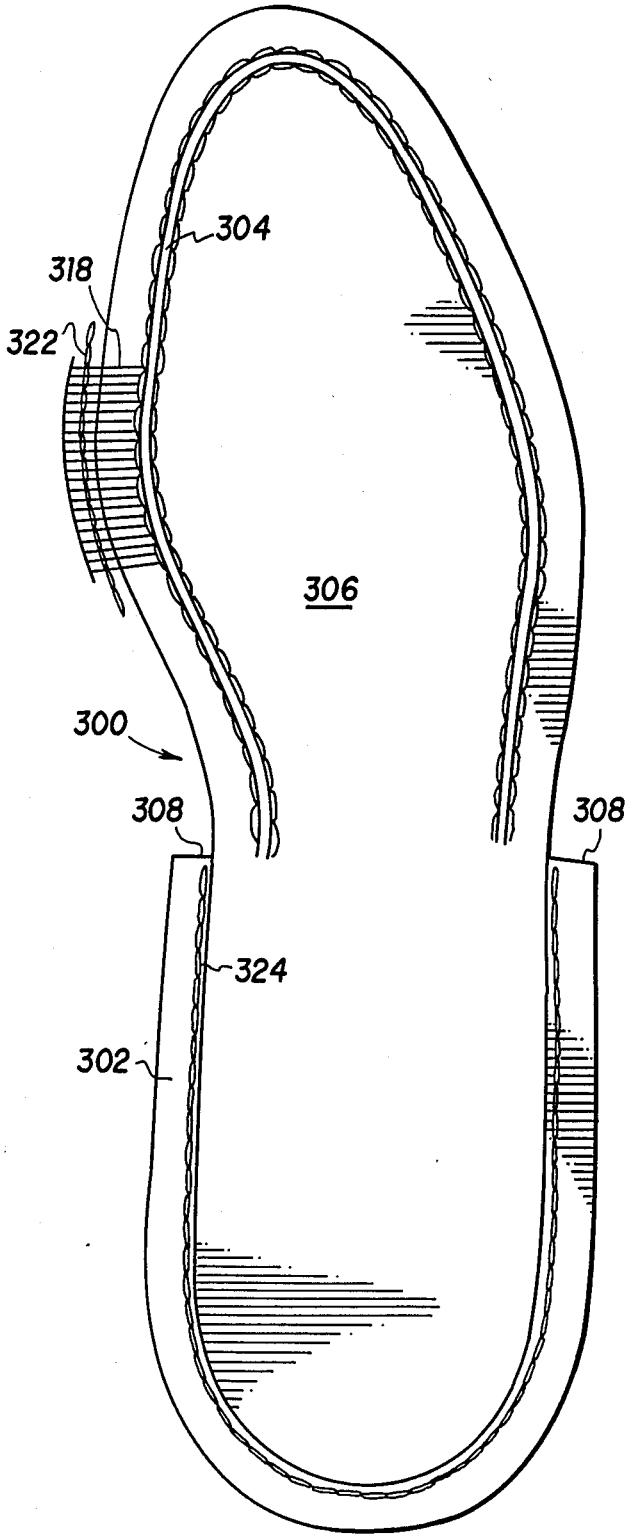
FIG. 21 is a plan view of a sole component of the shoe shown in FIGS. 20 and 21.

The embodiment shown in FIGS. 19–21 is somewhat different from all of the other embodiments in that some flexibility at the forepart is sacrificed for greater strength and protection of the foot. This embodiment is particularly suitable for use as a work shoe, unlike the other embodiments which are particularly suitable for casual shoes, such as moccasins, boat shoes, walking shoes, etc.

In the embodiments of 19–21, the construction of the rear part of the shoe is essentially the same as shown in FIG. 14. Thus, the rear portion 282 of the upper 280 includes a lining 284, foxing 286, padded collar 288, and the counter 60 of FIG. 5 with its stiff flange 66. The lining 284 has an outwardly extending margin 290 which lies under the flange 66 of the counter while the foxing 286 has a margin 292 which lies over flange 66.

The forepart of the upper 280 includes a one-piece vamp 294 and lining 296.

Unlike the other embodiments, the embodiment of FIG. 19–21 employs a welt-type shoe construction at the forepart. This is evident from an inspection of FIGS. 19 and 21. Referring first to FIG. 21 wherein the insole 300 is shown, it will be noted that a wide margin 302 is provided at the rear part of the sole component, and a rib 304 is shown extending about the forepart inwardly of the outer edge thereof. The rib 304 terminates at the shank region 306 closely adjacent to the front edges 308 of the lasting margin 302. The rib 304 may be formed either by cutting into the lower surface of the insole and turning the resulting flap downwardly to form the rib as conventionally practiced years ago in the shoe making art, or the rib may be separately fabricated in a "T" configuration and cemented to the bottom surface of the insole as is most commonly done today.

The forepart of the upper formed by the vamp 294 and lining 296 is shown turned under the periphery 310 of the midsole. When the upper is assembled to the insole, the margins 312 and 314 of the vamp and lining, respectively, are secured by Goodyear stitching 316 to the rib 304, and the same stitching 316 secures the welt 318 to the rib. The cavity in the lower surface of the forepart of the insole defined by the rib 304 is filled with a filler 320 as suggested in FIG. 19, and thereafter the outsole 322 is secured by Goodyear stitching 322 to the welt 318.

The rear part 282 of the upper is secured by Goodyear stitching 324 to the midsole 300 by passing the stitching through the margin 292 of foxing 286, the flange 66 of the counter 60 and the margin 290 of the lining, as is clearly illustrated in FIG. 20. The outsole 320 at the rear portion may be cemented to the lower surface of the insole 300. The shoe is completed by inserting a contoured heel pad 326 above the insole inside the upper to provide a comfortable platform for the foot, and a sock lining 328 may be inserted into the forepart as shown in FIG. 19.

In each of the embodiments of this invention the lasting margin of the rear part of the upper may be of sufficient width to enable it to be turned down and under the counter flange 66 and wide margin of the sole component as in FIG. 7 if that design is desired. It should also be appreciated that the rear part of the upper which contains counter 60 may be of many different forms. For example, the counter may be sandwiched between the lining and upper leather or between the upper leather and foxing, depending upon the styling of the upper desired. In all the embodiments, however, the lasting margin of the upper and the counter flange are turned outwardly over the wide margin in the sole component while the upper forepart is turned under at the feather edge. Furthermore, in all of the embodiments the part of the sole component to which the rear part of the upper is attached is relatively stiff as in the shoe of FIG. 1–7 so as to achieve the stability desired.

Having described this invention in detail, those skilled in the art will appreciate that numerous modifications may be made thereof without departing from the spirit of this invention. For example, while many different forepart constructions are shown in FIGS. 8–21, other styles may also be used. Therefore, it is not intended that the scope of this invention be limited to the several embodiments illustrated and described. Rather, the scope of this invention is to be determined by the appended claims and their equivalents.

We claim:

1. A shoe comprising a sole component having a forepart and a back part, said back part being relatively stiff and having a wide outwardly extending lasting margin extending about its periphery;

and an upper having a forepart and rear part, a molded counter with a stiff outwardly extending flange incorporated into and covered on the outside by the upper rear part, said upper rear part having a lasting margin which extends outwardly over the flange of the counter;

stitching joining the lasting margin of the back part of the sole component to the flange of the counter and the lasting margin of the rear part overlying the flange, said forepart of the upper having a base which is secured in face to face relationship to the forepart of the sole component.

2. A shoe as defined in claim 1 wherein the the base of the forepart of the upper is stitched to the forepart of the sole component.

3. A shoe as defined in claim 1 wherein the the base of the forepart of the upper is cemented to the forepart of the sole component.

4. A shoe as defined in claim 1 wherein the upper is of moccasin construction and includes foxing that overlies the counter.

5. A shoe as defined in claim 4 wherein the lower margin of the rear part overlying the flange of the counter is provided by the foxing.

6. A shoe as defined in claim 4 wherein the forepart of the upper is of moccasin construction, and a heel cushion insert is disposed on the upper surface of the sole component at the back part.

7. A shoe as defined in claim 6 wherein a welt is disposed on the upper surface of the forepart of the sole component about the feather edge.

8. A shoe as defined in claim 1 wherein an outsole is secured to the bottom surface of the sole component.

9. A shoe as defined in claim 1 wherein the rear part of the upper includes a lining which covers the inside surface of the counter and which has a bottom margin which underlies the flange of the counter and is sandwiched over the wide lasting margin of the sole component, and a mudguard is provided as part of the upper at the rear part thereof, said mudguard forming the lower margin of the upper which extends over the flange of the counter.

10. A shoe as defined in claim 9 wherein said stitching joins the lower margin of the upper, the flange of the counter, the bottom margin of the lining and the wide lasting margin of the sole component.

11. A shoe as defined in claim 10 wherein an outsole is secured to the bottom surface of the sole component.

12. A shoe comprising an upper having a forepart and a rear part;

a sole component underlying at least the rear part of the upper and having a wide outwardly extending lasting margin about its periphery and extending forwardly on the sides of the shoe to the shank region;

a molded counter with a stiff outwardly extending flange in the rear part of the upper, said rear part having a lasting margin which extends outwardly over the flange of the counter;

stitching joining the lasting margin of the sole component to the flange of the counter and the lasting margin of the rear part of the upper;

said forepart of the upper being of moccasin construction with a moccasin base for underlying the forepart of a foot placed in the shoe, and an outsole secured to the lower surface of the moccasin base.

13. A shoe as defined in claim 12 wherein said outsole is separate from the sole component and underlies the sole component.

14. A shoe as defined in claim 12 wherein the rear part of the upper includes a lining which covers the inside surface of the counter, and a mudguard is provided as part of the upper at the rear part thereof, said mudguard forming the lasting margin of the upper which extends outwardly over the flange of the counter.

15. A shoe as defined in claim 1 wherein said sole component is a midsole.

16. A shoe comprising a sole component having a forepart and a back part, said back part being relatively stiff and having a wide outwardly extending lasting margin extending about its periphery;

and an upper having a forepart and rear part, a molded counter with a stiff outwardly extending flange and covered on the outside by the rear part, said rear part having a lower margin which extends outwardly over the flange of the counter;

stitching joining the lasting margin of the back part of the sole component to the flange of the counter and the lasting margin of the rear part overlying the flange, and an insole secured to the forepart of the upper and secured in face to face relationship to the sole component.

17. A shoe comprising a sole and an upper;

said sole including a sole component having a back part, said back part having a wide outwardly extending lasting margin extending about its periphery;

said upper including a forepart and a rear part with a feather edge and a stiff counter;

an outwardly extending stiff lasting flange forming part of the counter positioned over the wide lasting margin of the sole component, said rear part of said upper having an outwardly extending lasting margin beyond the feather edge and overlying the flange of the counter;

stitching joining the lasting margin of the rear part of the upper and lasting flange of the counter to the upper surface of the wide lasting margin of the sole component for imparting lateral stability to the rear part of the shoe;

said upper forepart having an inwardly turned bottom portion stitched to the surface of the sole component and providing substantial fore and aft flexibility to the shoe.

18. A shoe as defined in claim 17 wherein the sole component is a midsole.

and an insole secured to the inwardly turned bottom portion of the forepart of the upper and overlying the forepart of the sole component.

19. A shoe as defined in claim 17 wherein the rear part of the upper includes a lining disposed on the inside of the counter and foxing disposed outside the counter, the outwardly extending lasting margin of the rear part of the upper being provided in the foxing, said lining having a lower portion which is turned inwardly over the sole component and inside the lasting margin of the sole component.

20. A shoe as defined in claim 19 wherein the sole component is a midsole, and an insole secured to the lower margin of the lining at the rear part and to the inwardly turned bottom portion of the forepart of the upper and overlying the midsole.

21. A shoe as defined in claim 20 wherein the insole is stitched to the upper about the periphery of the bottom of the upper inwardly of the feather edge.

22. A shoe as defined in claim 21 wherein a welt is secured to the periphery of the upper surface of the midsole forwardly of the lasting flange of the counter.

23. A shoe as defined in claim 21 wherein the upper forepart has a lining with a bottom margin overlying the inwardly turned bottom portion of the forepart, said lining being stitched together with the bottom portion to the sole component.

24. A shoe comprising a sole component having a forepart and a back part, said back part being relatively stiff and having a wide outwardly extending lasting margin extending about its periphery;

and an upper having a forepart and rear part, a molded counter with a stiff outwardly extending flange incorporated into and covered on the outside by the upper rear part, said rear part having a lasting margin which extends outwardly over the flange of the counter;

stitching joining the lasting margin of the back part of the sole component to the flange of the counter and the lasting margin of the rear part overlying the flange, and a welt-type construction joining the forepart of the upper to the forepart of the sole component.

25. A shoe as defined in claim 24 wherein a rib is provided on the lower surface of the forepart of the sole component extending rearwardly to adjacent the forward ends of the wide lasting margin of the rear part of the sole component, the forepart of the upper having a lasting margin turned under the periphery of the sole component, a welt disposed on the bottom of the sole component about the periphery of the forepart, and stitching joining the lasting margin of the forepart of the upper and the welt to the rib.

* * * * *